United States Patent [19]

Marino

[11] Patent Number: 5,071,166

[45] Date of Patent: Dec. 10, 1991

[54] ENVIRONMENTALLY DESIGNED TRANSPORTABLE HOLDING TANK

[76] Inventor: Thomas Marino, 26 Hydelor Ave., Prospect, Conn. 06712

[21] Appl. No.: 464,317

[22] Filed: Jan. 12, 1990

[51] Int. Cl.[5] ..... B60P 3/22

[52] U.S. Cl. ..... 280/830; 220/445; 220/469; 220/571; 280/837; 280/839

[58] Field of Search ..... 280/830–839; 220/571, 564, 562, 85 H, 408, 4.21, 412, 445, 469, DIG. 24, 351, 345, 466, 601, 661; 222/130, 131, 94, 105

[56] References Cited

U.S. PATENT DOCUMENTS

| | | | |
|---|---|---|---|
| 1,511,613 | 10/1924 | Joern | 220/345 |
| 2,366,796 | 1/1945 | Lawrence et al. . | |
| 2,824,431 | 2/1958 | Pearson . | |
| 2,824,432 | 2/1958 | Varese et al. . | |
| 2,944,563 | 7/1960 | De Blasio et al. | 220/445 X |
| 3,079,061 | 2/1963 | Wojcik . | |
| 3,547,301 | 12/1970 | Flooks . | |
| 3,793,145 | 2/1974 | Jordan et al. . | |
| 3,848,765 | 11/1974 | Dürkop | 220/469 X |
| 4,162,020 | 7/1979 | Kirkland | 220/571 x |
| 4,315,531 | 2/1982 | Gerhard . | |
| 4,395,052 | 7/1983 | Rash | 280/832 X |
| 4,496,073 | 2/1985 | Silver et al. . | |
| 4,502,610 | 3/1985 | Todd | 220/351 X |
| 4,589,565 | 5/1986 | Spivey . | |
| 4,638,920 | 1/1987 | Goodhues, Jr. | 220/445 |
| 4,640,439 | 2/1987 | Palazzo . | |
| 4,696,186 | 9/1987 | Sharp . | |
| 4,697,618 | 10/1987 | Youtt et al. . | |
| 4,815,621 | 3/1989 | Barns | 220/85 R X |
| 4,819,955 | 4/1989 | Cobb | 280/837 |
| 4,912,966 | 4/1990 | Sharp | 220/469 X |
| 4,920,222 | 10/1990 | Fields | 220/445 |
| 4,934,553 | 6/1990 | McCarthy | 220/469 X |
| 4,895,272 | 1/1990 | De Benedittis et al. | 220/85 S |
| 5,016,689 | 5/1991 | McGarvey et al. | 220/469 X |

FOREIGN PATENT DOCUMENTS

| | | | |
|---|---|---|---|
| 1270048 | 11/1986 | U.S.S.R. | 280/830 |

*Primary Examiner*—Michael J. Hill

[57] ABSTRACT

An environmentally safe transportable liquid holding tank has an inner tank and a rigid enclosure spaced outwardly therefrom to provide a compartment therebetween. At least one access assembly is provided on the top of the enclosure and the inner tank, and this assembly includes a removable closure on the tankand a displaceable cover over that closure which extends across an upwardly opening recess defined within the access assembly and extending about the closure in the tank. Pump out conduits extend to the upper portion of the enclosure, and wheels are provided on the base of the unit to enable its movement from place to place.

19 Claims, 5 Drawing Sheets

ENVIRONMENTALLY DESIGNED TRANSPORTABLE HOLDING TANK

BACKGROUND OF THE INVENTION

The present invention relates to liquid storage tanks, and, more particularly, to a transportable environmentally safe tank for holding liquids such as spent or contaminated oils.

Over the past two decades there has been growing concern with respect to the disposal of waste materials of various types. There has been substantial concern raised with respect to disposal of oils, solvents, acids and various other liquid wastes. Recent federal and state legislation has mandated recycling both solid and liquid wastes and imposing restrictions upon the types of wastes which may be put in landfills.

Although some states have imposed restrictions upon the disposal of waste motor oils and other liquids by industrial and commercial concerns, homeowners and many small businesses have continued to dispose of such liquid wastes improperly in normal garbage containers, thus complicating the problems of recycling and control of land fills.

In some industrial and commercial facilities used, barrels and the like are provided for collection of the waste oil and for subsequent transport to disposal or recycling areas. Since many of the containers which are used for this purpose have themselves been recycled from prior uses and do not seal well, leakage is not uncommon causing additional hazards to the environment.

Accordingly, it is an object of the present invention to provide a novel, environmentally safe and transportable liquid holding tank.

It is also an object to provide such a liquid holding tank which may be fabricated readily and which effectively ensures against leakage, while at the same time providing easy access for placement of the liquid wastes therein.

Another object is to provide such a liquid holding tank which may be readily transported to recycling or collection facilities and easily pumped out at such facilities.

SUMMARY OF THE INVENTION

It has now been found that the foregoing and related objects and advantages may be readily attained in an environmentally safe transportable liquid holding tank which includes an inner tank having end walls and a peripheral wall. A rigid enclosure extends about the tank and has a base wall end walls top wall and side walls, and at least the end and side walls are spaced outwardly from the end walls and peripheral wall of the tank to provide a compartment therebetween equal in volume to at least one-half the volume of the tank.

The tank is supported within the enclosure in its spaced relationship by support elements, and the enclosure in turn is supported upon a base. At least one access assembly is provided at the top of the enclosure and the inner tank, and it includes a removable closure on the tank closing an opening into the tank. The access assembly defines an upwardly recess therewithin which extends about the closure, and the assembly also has a displaceable cover over the recess. A first pump out conduit extends upwardly from the bottom of the tank to the upper portion of the enclosure.

Preferably, the base wall is also spaced from the tank to provide a sump about the tank and a second pump out conduit extends from the sump to the upper portion of the enclosure. A removable cover on the enclosure is disposed over the upper end of the conduits to limit access thereto. Desirably, the conduits extend to the recess and the cover of the assembly provides the access thereto.

In the usual configuration, a vent is provided from the enclosure to the atmosphere, and the tank is of generally cylindrical configuration and the enclosure is of generally rectangular configuration. Desirably, the compartment defined between the tank and enclosure has a volume at least equal to that of the tank. The upwardly opening recess extends below the level of closure to provide a catch basin thereabout, and the cover is slidably supported on the enclosure. In the preferred structure, a second opening is provided in the tank within the enclosure to drain fluid from the catch basin into the tank, and there i also provided a removable cap for the second opening.

Desirably, there is included a platform on the enclosure to provide a person standing thereon with facile access to the cover and closure for introducing liquids into the tank. A ladder is provided on the enclosure to enable a person to readily climb to the top wall of the enclosure. The base has wheels thereon to facilitate its transport from the collection point to a disposed area.

Preferably, the tank has at least one transverse wall therein dividing the interior thereof into multiple compartments and at least two access assemblies are provided for separate access to the multiple compartments.

DETAILED DESCRIPTION OF THE ILLUSTRATED EMBODIMENTS

Figure 1:
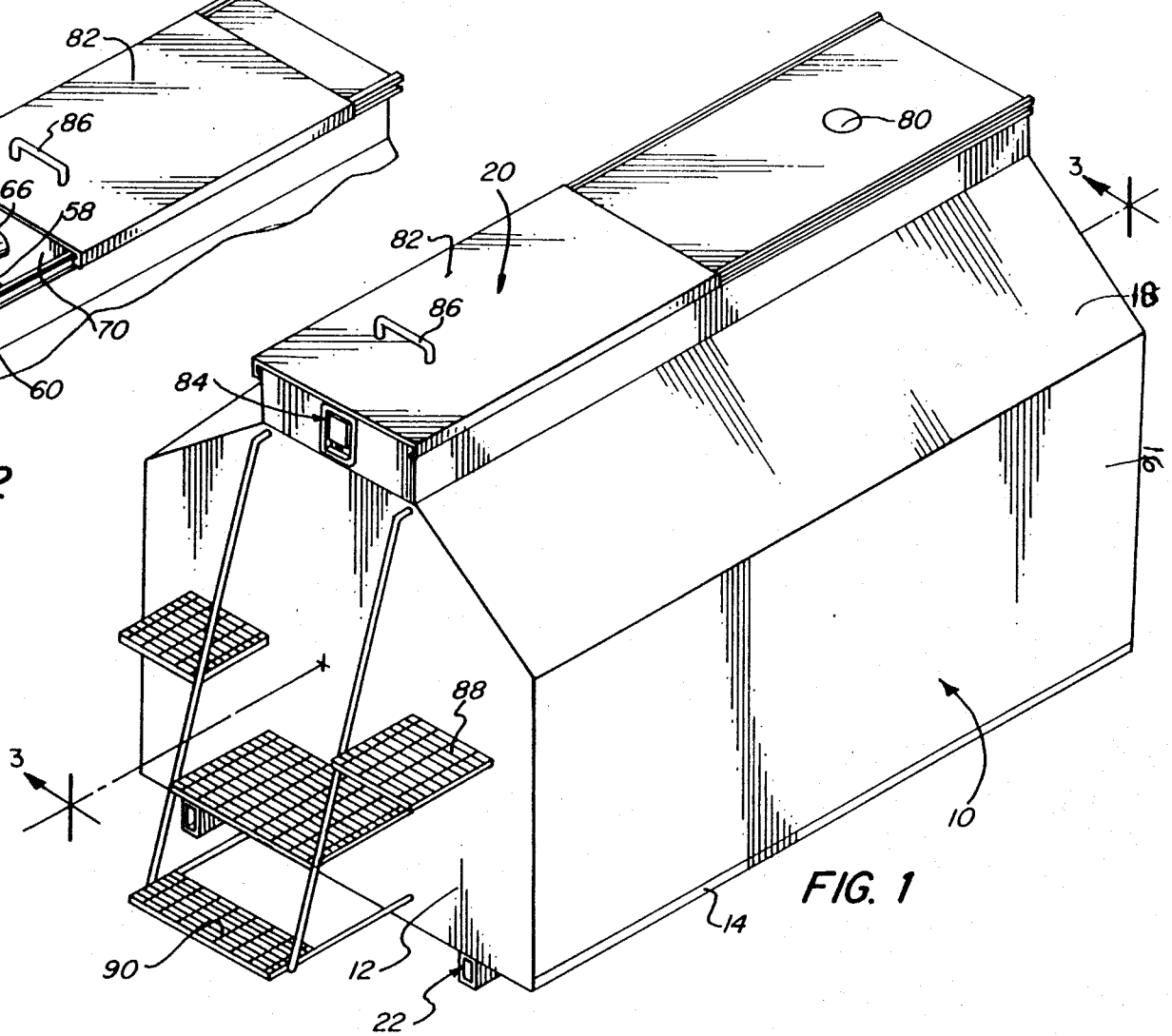
FIG. 1 is a perspective view of a liquid holding tank embodying the present invention with the cover in the closed position.

Turning first to FIGS. 1-6, therein illustrated is an environmentally safe holding tank for liquids embodying the invention and comprising an outer enclosure generally designated by the numeral 10 formed by the end walls 12, base wall 14, side walls 16, sloping top walls 18, and an access assembly generally designated by the numeral 20. The enclosure 10 is supported upon a base best seen in FIG. 5 and generally designated by the numeral 22. The base 22 is provided by the longitudinal rails 24 transverse rails 26. and at one end the base 22 has wheels 30 rotatably mounted thereon. At the other end is a hitch 32 by which the holding tank may be pulled.

Figure 6:
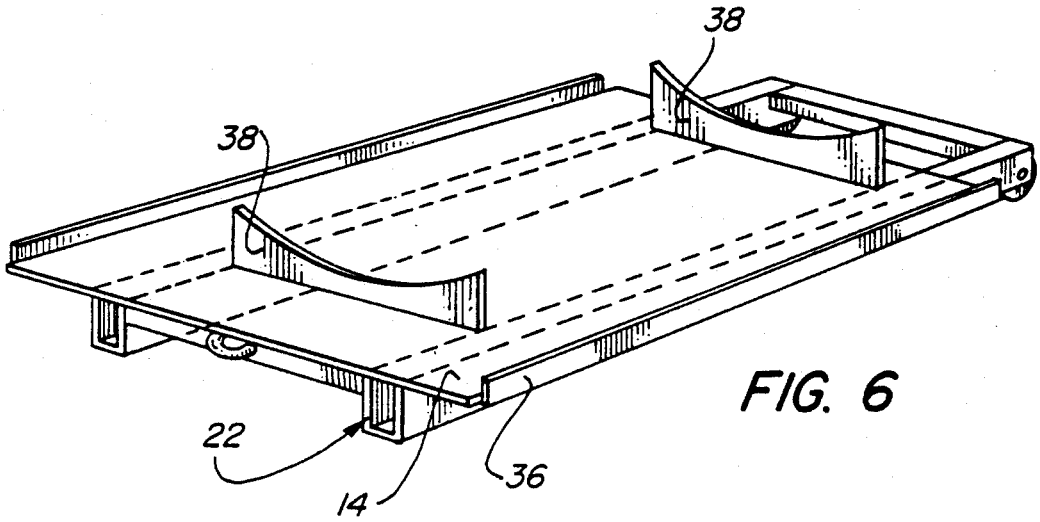
FIG. 6 is a perspective view of the base with the bottom wall of the enclosure disposed thereon and with the cradles for the inner tank disposed on the base wall.

As seen in FIG. 6, the base wall 14 has longitudinally extending, upstanding flanges 36 along its sides thereof, and the cradles 38 are mounted thereon.

Figure 3:
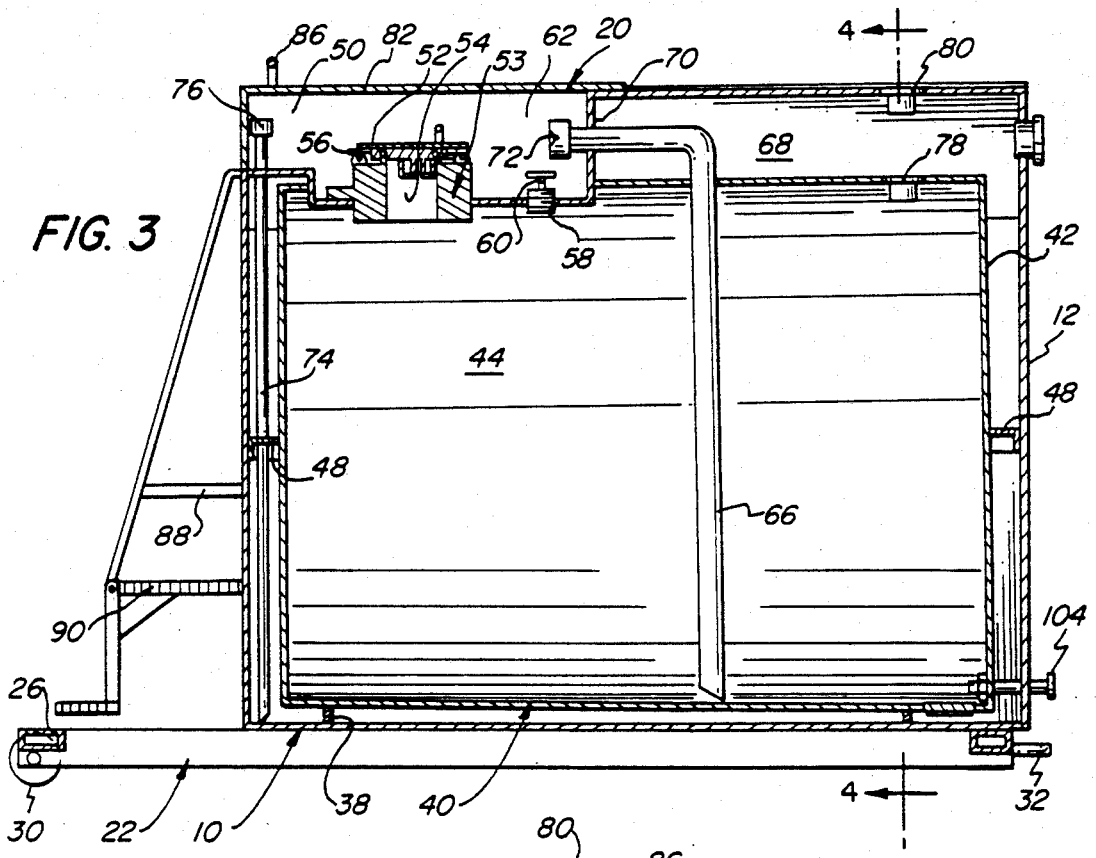
FIG. 3 is a longitudinal sectional view thereof along the sectional line 3—3 of FIG. 1.
Figure 4:
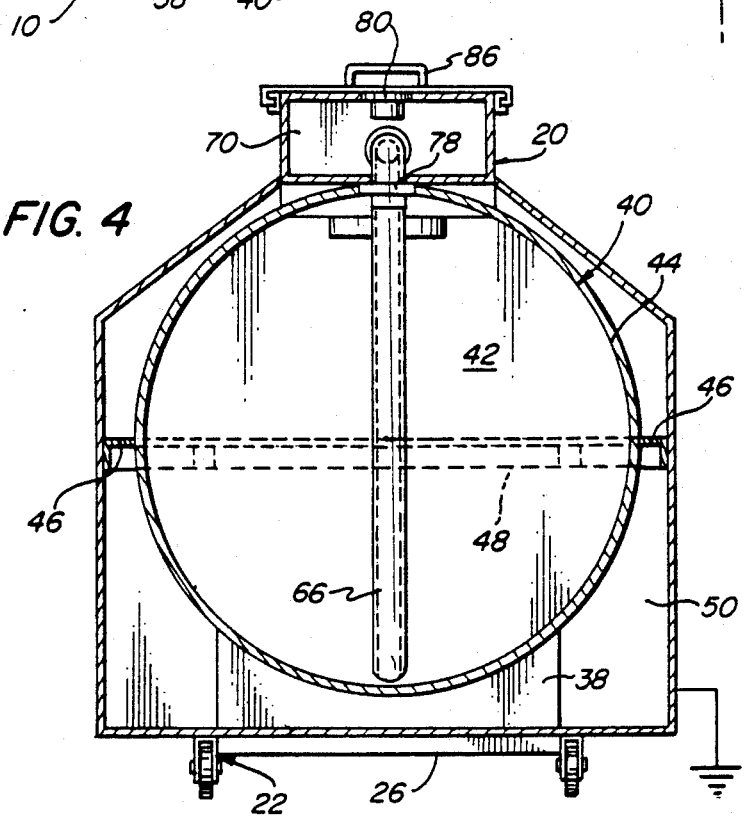
FIG. 4 is a transverse sectional view thereof along the line 4—4 of FIG. 3.
Figure 5:
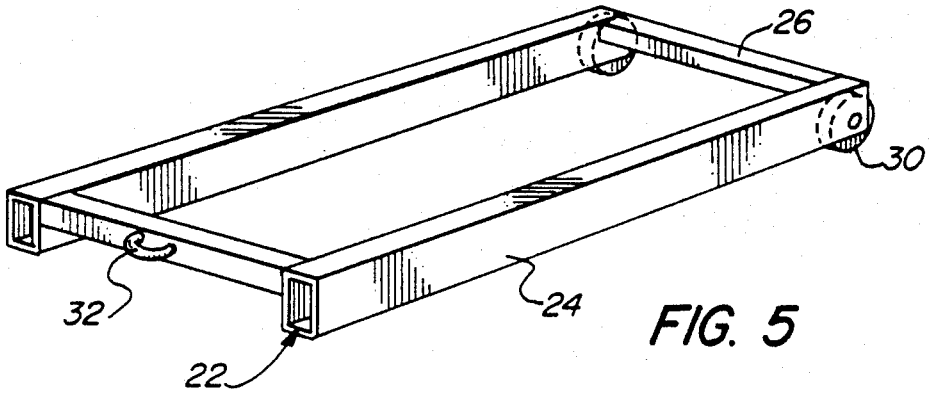
FIG. 5 is a perspective view of the base for the tank of FIG. 1.

As seen in FIGS. 3 and 4, a cylindrical inner tank generally designated by the numeral 40 is seated on the cradles 38 and it has end walls 42 and a peripheral wall 44. The tank 40 is positioned in spaced relationship from the side walls 16 by the longitudinally extending spacer flanges 46 and from the end walls 12 by the end spacer flanges 48. As a result, a compartment 50 is defined between the outer surface of the tank 40 and the inner surface of the enclosure 10.

Figure 2:
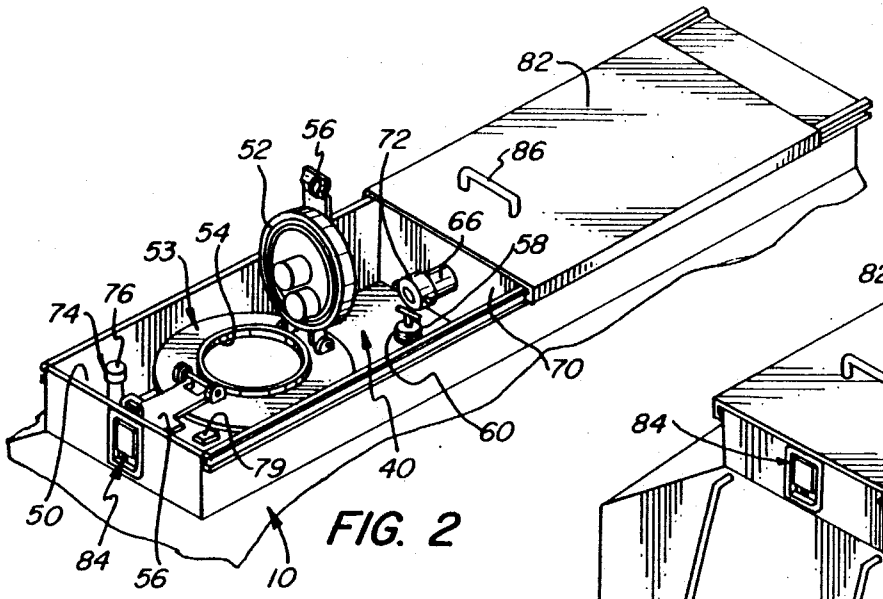
FIG. 2 is a fragmentary perspective view thereof with the protective cover moved to an open position and with the cover moved into a top opening position.

As seen in FIG. 3, there is provided at the top of the enclosure an access assembly 20 which includes a "manhole" access into the tank 40 including closure 52 over a fill aperture 54 in the top of the tank 40. As seen in FIG. 2, the closure 52 is pivotally supported to one side of the fill aperture 54 and it may be locked in place by the lock elements 56. Spaced from the fill aperture 54 is a drain fitting 58 which is sealed by removable cap 60. As can be seen, the access assembly 20 defines a compartment about the closure 52 and drain 58, and this compartment provides an upwardly opening recess in which a spill may be contained and the liquid ultimately drained into the tank 40 through the drain 58.

Extending upwardly from the bottom of the tank 40 is a first pump out conduit 66 which passes through the upper portion of the inner tank 40 into a closed compartment 68 within the outer enclosure 10, and thence through the wall 70 into the recess 62 of the compartment provided by the access assembly 20. A removable cap 72 is provided over the upper end of the pump out conduit 66. In addition, a smaller diameter second pump out conduit 74 is disposed rearwardly of the tank 40 in the space between it and the end wall 12 of the outer enclosure 10. The conduit 74 extends upwardly into the compartment provided by the access assembly 20 and has a removable cap 76 thereon.

As best seen in FIG. 3, the tank 40 has a vent 78 which opens within the closed compartment 68 and a second vent 80 is provided in the upper wall of the closed compartment 68 to vent to the atmosphere. Both of these vent fittings 78, 80 contain sealing elements (not shown) which will close the passage therethrough in the event that the tank should be tipped over.

Slidably supported on the side walls of the access assembly 20 is a slide cover 82 which may be moved from a position overlying the access compartment 50 to a position forwardly thereof to permit access to all of the operating elements. As seen in FIG. 2, a lock 84 is provided at the rearward end of the access assembly 20 to enable locking the cover 82 in a closed position. A handle 86 is provided on the cover to facilitate its movement back and forth.

As seen in FIGS. 1 and 3, platforms 88 and steps 90 are provided on the rear of the enclosure 10 to enable a person to step thereon to open the cover 82 and the closure 52 to the tank 40 for purposes of discharging liquid thereinto, or to make connections to the pump out conduits as the case may be.

Figure 7:
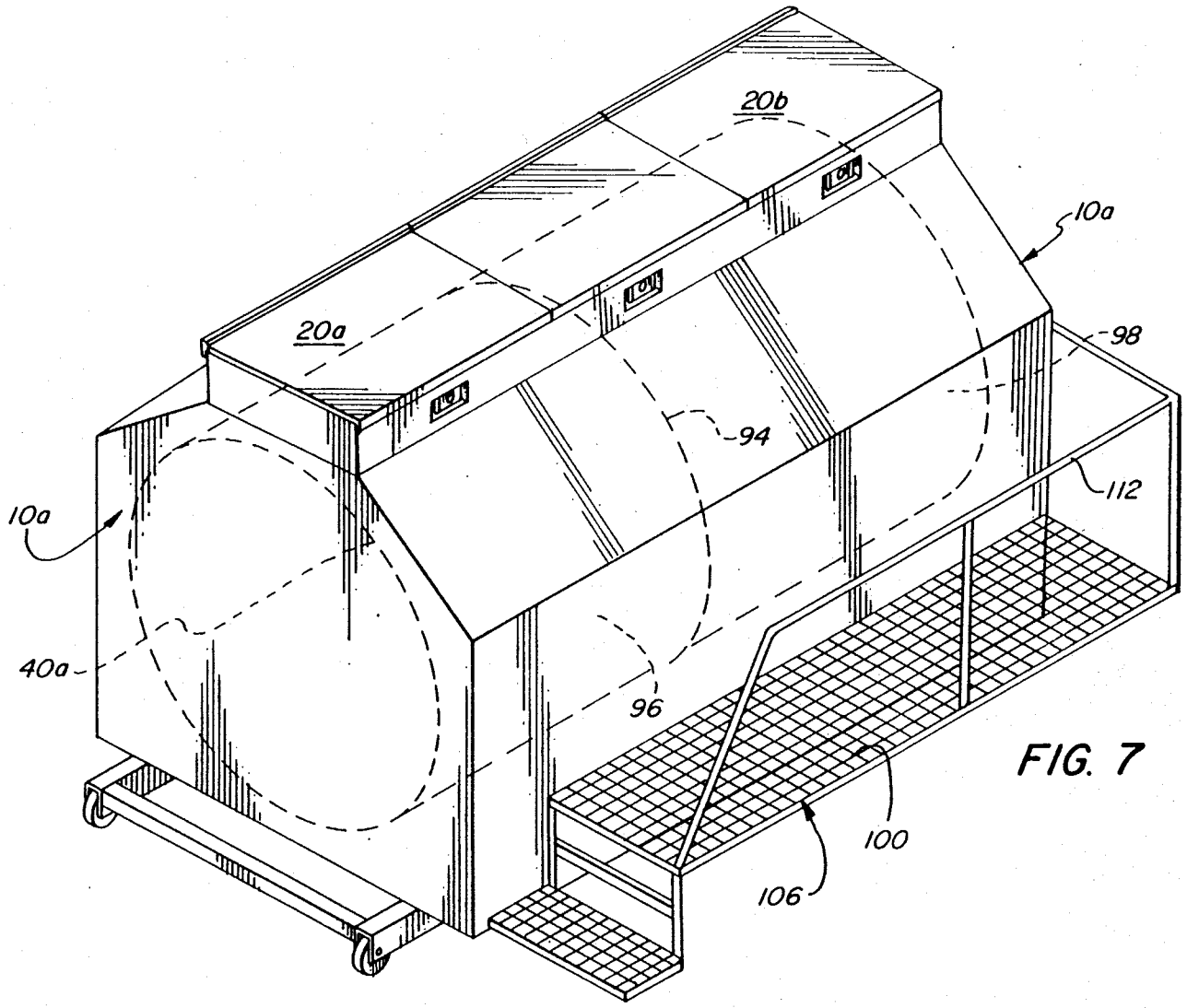
FIG. 7 is a perspective view of another embodiment of the liquid holding tank with the top covers in a closed position.
Figure 8:
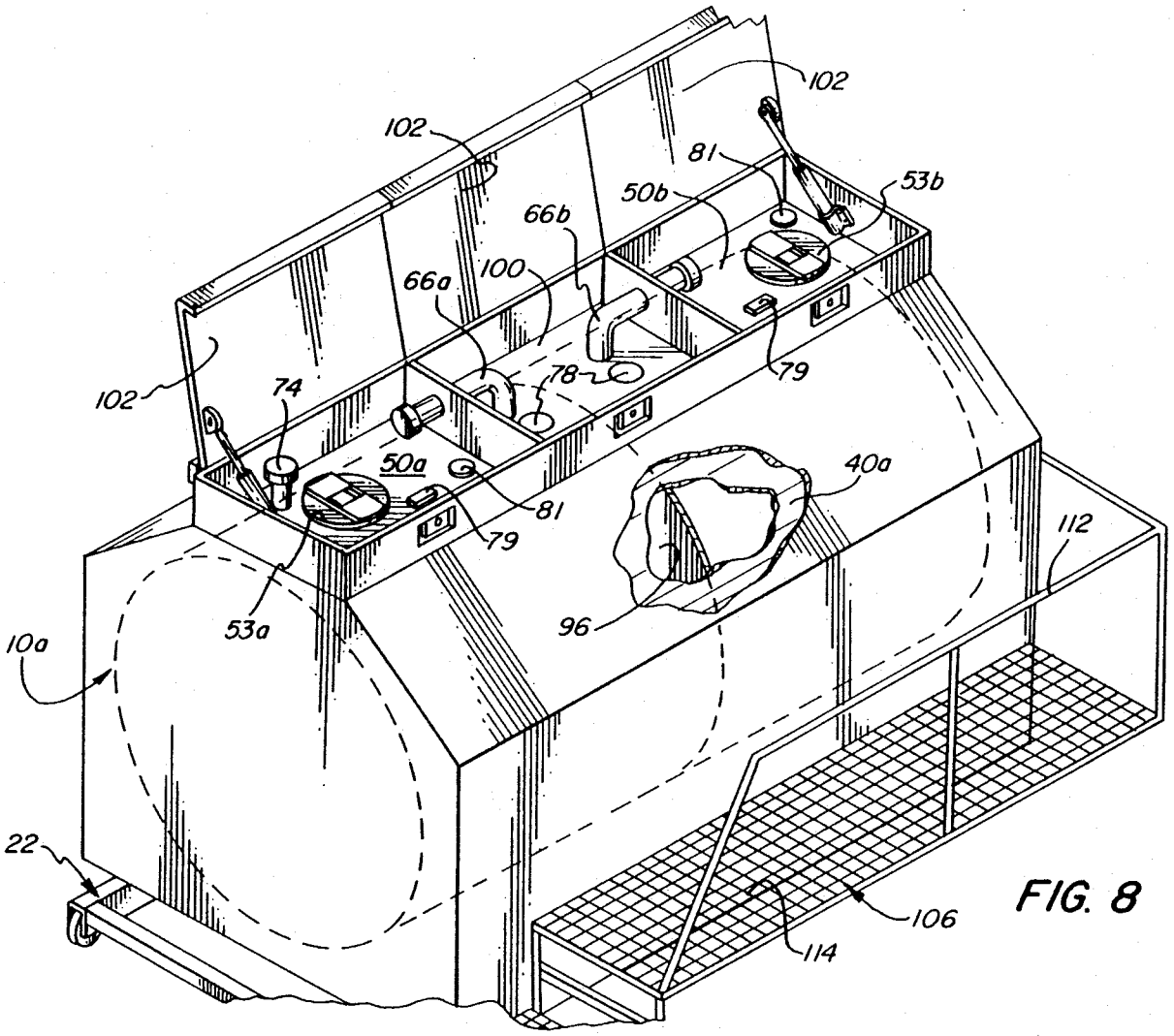
FIG. 8 is a perspective view of the embodiment of FIG. 7 with the top covers pivoted into an open position.

Turning now to the embodiment of FIGS. 7 and 8, the inner tank 40*a* is divided into a pair of compartments 96, 98 by a transverse wall 94 intermediate the length thereof. In this embodiment, a pair of access assemblies 20*a* and 20*b* are provided at the front and rear of the tank and an intermediate compartment 100 is disposed therebetween. In this embodiment, each of the access compartments 50*a*, 50*b* and the intermediate compartment 100 may be sealed by pivotably mounted covers 102 which can be latched in place.

The access assemblies 20*a* and 20*b* each have a "manhole" generally designated by the numeral 53*a* and 53*b* respectfully for introduction of liquids into the respective compartments of the tank 40*a*. The sump pump out conduit 74 opens into the compartment 50*a* and has a closure over the end thereof. Pump out conduits 66*a* and 66*b* from the front and rear compartments of the tank 40*a* extend upwardly into the intermediate compartment 100 and thence through the walls defining the intermediate compartment 100 and into the compartments 50*a* and 50*b* of the access assemblies 20*a* and 20*b* for purposes of pumping out the respective compartments of the tank 40*a*. Leak detectors 79 and liquid level gauges 81 are provided in each of the compartments 50*a* and 50*b*.

In this embodiment the platform and ladder assembly 106 is provided along the side of the enclosure 1O*a* and a rail 112 is desirably provided about the platform 114. For convenience of transporting the tank, the platform assembly 106 is pivotably mounted on the enclosure 10*a* and may be folded against its side and secured by releasable fittings which do not require the use of tools.

As is also shown in FIG. 8, vents 78 are provided from each of the compartments of the tank and through the cover 102 of the intermediate compartment 100.

As also seen in FIG. 3, a ground rod 104 extends through the enclosure 10 into the tank 40 to provide a terminal for a grounding strap (not shown) to discharge any static electricity to ground. Not shown are the gaskets provided about all the caps and covers for effective sealing action to prevent leakage from the container in the event that it is tipped over during transit or by vandalism.

In operation, the tank is placed at a suitable location on a site for access by residents of the community if it is a community disposal or within or adjacent an industrial or commercial establishment from which wastes are to be received. During periods of non-use, the cover(s) is maintained in a locked condition. To enable use, the person having custody of the key for the lock opens the cover and may unlatch the closure to facilitate access and use of the tank by others.

A person having liquid waste to place in the tank, steps on the platform, opens the closure and pours the liquid thereinto. In the event that there is spillage, the cap can be removed from the drain to allow the spillage to drain into the tank. As the tank is being filled, air is displaced from the interior through the fill opening and through the vent in the top of the tank. Moreover, expansion within the tank as the result of heating is readily accommodated through the vent in the tank. In the event that the tank should rupture at any point thereabout, the liquid therein will flow into the compartment formed between the tank and the outer enclosure, and the liquid which flows into this space may be pumped out through the conduit which extends downwardly to the sump.

At such time as it is desired to move the tank to another location or to a recycling site or pump out station, the tank may be winched onto a suitable trailer by attaching a cable to the hitch fitting at the front thereof and lifting it onto the bed of the trailer or by rolling it onto the bed of the trailer. At the recycling site, the cover is opened and a pump out hose is attached to the end of the pump out conduit to enable the substantially all of the contents to be withdrawn.

In the embodiment of FIGS. 7 and 8, two separate compartments are provided within the tank. However, it will be appreciated if three or more compartments of smaller volume may also be provided with separate access assemblies so that a single tank may be used to segregate different types of liquid waste.

Desirably, the enclosure about the tank provides a compartment which is equal to the volume of the tank plus an additional 10% in order to comply with the normal rules of thumb used by the state and federal environmental protection agencies.

The platform elements on the tank may be readily removable or they may be provided with pivotal fittings to allow them to be folded upwardly or downwardly for storage against the walls of the enclosure during transport.

Although the enclosure in the illustrated embodiments is generally of polygonal cross section, it will be appreciated that it may also have a circular cross section; albeit with greater difficulty in mounting platforms and steps for use of the tank.

Thus, it can be seen from the foregoing detailed description and the attached drawings that the tank of the present invention is one which may be readily fabricated and which may enjoy extended life. The enclosure about the tank provides a built-in means for precluding spillage in the event of rupture of the primary inner tank. Moreover, the tank is readily sealed for substantial protection against spillage in the event that the tank is tipped over during transport or by vandalism. The tank is readily adapted to being partitioned into multiple compartments for separate storage of various types of liquid waste. Moreover, the tank may be readily transported to other sites serving as temporary collection points and to recycling facilities for pumping out.

Having thus described the invention, what is claimed is:

1. An environmentally safe transportable liquid holding tank comprising (a) an inner tank having end walls and a peripheral wall and having a top and a bottom;

(b) a rigid enclosure about said tank and having a top and a bottom with a base wall, end walls, top wall and side walls, at least said end and side walls being spaced outwardly from said end walls and peripheral wall of said inner tank to provide a compartment therebetween equal in volume to at least one-half the volume of said inner tank;

(c) support elements supporting said inner tank within said enclosure in said spaced relationship;

(d) a base on which said enclosure is supported;

(e) at least one access assembly at said top of said enclosure and said inner tank, said access assembly including a removable closure on said inner tank closing an opening into said tank disposed in a substantially horizontal plane, said access assembly defining an upwardly opening recess therewithin and in said peripheral wall of said inner tank extending about said removable closure, and said assembly further having a displaceable cover over said recess to provide an outer closure for the opening in said top of said rigid enclosure over said removable closure on said inner tan;

(f) a first pump out conduit extending upwardly from said bottom of said inner tank to the upper portion of said enclosure; and (g) a second pump out conduit extending from the bottom of said compartment defined between said enclosure and inner tank to the upper portion of said enclosure.

2. The liquid holding tank in accordance with claim 1 wherein said base wall of said rigid enclosure is also spaced from said inner tank to provide a sump about said inner tank, and said second pump out conduit extends from said sump to the upper portion of said enclosure.

3. The liquid holding tank in accordance with claim 1 wherein a removable cover on the upper portion of said enclosure is disposed over the ends of said conduit adjacent said upper portion of said enclosure to limit access thereto.

4. The liquid holding tank in accordance with claim 3 wherein said conduits extend to said recess of said access assembly and said cover of said assembly provides access thereto.

5. The liquid holding tank in accordance with claim 1 wherein a vent is provided from said enclosure to the atmosphere.

6. The liquid holding tank in accordance with claim 1 wherein said inner tank is of generally cylindrical configuration and said enclosure is of generally rectangular configuration.

7. The liquid holding tank in accordance with claim 1 wherein said compartment defined between said inner tank and enclosure has a volume at least equal to that of said inner tank.

8. The liquid holding tank in accordance with claim 1 wherein said upwardly opening recess extends below the plane of said closure to provide a catch basin thereabout.

9. The liquid holding tank in accordance with claim 8 wherein a second opening is provided in said inner tank within said inner opening to drain fluid from said catch basin into said tank, and there is also provided a removable cap for said second opening.

10. The liquid holding tank in accordance with claim 1 wherein said cover is slidably supported on said enclosure.

11. The liquid holding tank in accordance with claim 1 wherein there is included a platform on said enclosure to provide a person standing thereon with facile access to said cover and closure to enable facile introduction of liquids into said inner tank.

12. The liquid holding tank in accordance with claim 10 wherein there is included a ladder on said enclosure to enable a person to climb to the top wall of said enclosure.

13. The liquid holding tank in accordance with claim 1 wherein said base has wheels thereon for transport of the holding tank.

14. The liquid holding tank in accordance with claim 1 wherein said inner tank has at least one transverse wall therein dividing the interior thereof into multiple compartments and at least two access assemblies are provided for separate access to said multiple compartments.

15. An environmentally safe transportable liquid holding tank comprising (a) an inner tank having end walls and a peripheral wall and having a top and a bottom;

(b) a rigid enclosure about said tank and having a top and a bottom with a base wall, end walls, top wall and side walls, said base, end and side walls being spaced outwardly from said end walls and peripheral wall of said inner tank to provide a sump therebelow and a compartment therebetween equal in volume to at least one-half the volume of said inner tank;

(c) support elements supporting said inner tank within said enclosure in said spaced relationship;

(d) a base on which said enclosure is supported, said base having wheels thereon for transport of the holding tank;

(e) at least one access assembly at said top of said enclosure and said inner tank, said access assembly including a removable closure on said inner tank closing an opening into said inner tank disposed in a horizontal plane, said access assembly defining an upwardly opening recess therewithin and in said peripheral wall of said inner tank extending about said removable closure and therebelow to provide a catch basin thereabout, said assembly also having a displaceable cover over said recess to provide an outer closure for the opening in said top of said rigid enclosure over said removable closure on said inner tank, a second opening in said inner tank within said enclosure to drain fluid from said catch basin into said inner tank, and a removable cap for said second opening;

(f) a first pump out conduit extending upwardly from said bottom of said inner tank to the upper portion of said enclosure;

(g) a second pump out conduit extending from said sump to the upper portion of said enclosure; and (h) a vent from said enclosure to the atmosphere.

16. The liquid holding tank in accordance with claim 15 wherein a removable cover on the upper portion of said enclosure is disposed over the ends of said conduits adjacent said upper portion of said enclosure to limit access thereto and wherein said conduits extend to said recess of said access assembly and said cover of said assembly provides access thereto.

17. The liquid holding tank in accordance with claim 15 wherein said inner tank is of generally cylindrical configuration and said enclosure is of generally rectangular configuration, and wherein said compartment defined between said inner tank and enclosure has a volume at least equal to that of said inner tank.

18. The liquid holding tank in accordance with claim 15 wherein there is included a platform on said enclosure to provide a person standing thereon with facile access to said cover and closure to enable facile introduction of liquids into said inner tank, and there is also included a ladder on said enclosure to enable a person to climb to the top wall of said enclosure.

19. The liquid holding tank in accordance with claim 15 wherein said inner tank has at least one transverse wall therein dividing the interior thereof into multiple compartments and at least two access assemblies are provided for separate access to said multiple compartments.

* * * * *

UNITED STATES PATENT AND TRADEMARK OFFICE

CERTIFICATE OF CORRECTION

PATENT NO. : 5,071,166

DATED : December 10, 1991

INVENTOR(S) : Thomas Marino

It is certified that error appears in the above-identified patent and that said Letters Patent is hereby corrected as shown below:

Column 5, line 68, delete "tan" and insert --tank--.

Column 6, line 36, delete "closure" and insert --opening--.

Column 6, lin 40, delete "inner opening" and insert --enclosure--; Line 41, before "tank", insert --inner--.

Signed and Sealed this

Thirtieth Day of March, 1993

*Attest:*

STEPHEN G. KUNIN

*Attesting Officer*

*Acting Commissioner of Patents and Trademarks*